United States Patent [19]

Genzling et al.

[11] 4,420,843

[45] Dec. 20, 1983

[54] CYCLISTS' GLOVES

[76] Inventors: Claude Genzling, 7, rue Serevo, Paris, France, 75014; Michel Mathieu, 4, Allée du Chatellier, Lussault, France, 37400

[21] Appl. No.: 367,893

[22] Filed: Apr. 13, 1982

[30] Foreign Application Priority Data

Apr. 16, 1981 [FR] France ..... 81 07682

[51] Int. Cl.[3] ..... A41D 19/00

[52] U.S. Cl. ..... 2/161 A; 2/164

[58] Field of Search ..... 2/160, 161 A, 164, 20, 2/168, 159, 267, 272, 16, 17; 128/77, 80 R, 595, 81 R

[56] References Cited

U.S. PATENT DOCUMENTS

| | | | |
|---|---|---|---|
| 2,302,875 | 11/1942 | Lykins . | |
| 3,890,648 | 6/1975 | Beal | 2/20 |
| 3,890,649 | 6/1975 | Diggins | 2/161 A |
| 3,916,448 | 11/1975 | Hamel | 2/164 |
| 4,089,070 | 5/1978 | Cherry . | |
| 4,183,100 | 1/1980 | De Marco | 2/164 |

FOREIGN PATENT DOCUMENTS

| | | |
|---|---|---|
| 964986 | 4/1948 | France . |
| 1502070 | 10/1966 | France . |
| 103361 | 2/1917 | United Kingdom . |
| 710394 | 6/1954 | United Kingdom . |

*Primary Examiner*—Louis Rimrodt
*Assistant Examiner*—Steven N. Meyers
*Attorney, Agent, or Firm*—Wilson, Fraser, Barker & Clemens

[57] ABSTRACT

The present invention relates to an improvement to cyclists' gloves, wherein a lining member is provided inside the glove, which lining member is placed between the cyclist's hand and the wall of the glove, the said lining member having a part which adopts the outline of the palm of the hand and a collar-shaped part provided with an opening on one side, defining the space between the thumb and the index, when the hand is half-closed.

4 Claims, 5 Drawing Figures

CYCLISTS' GLOVES

The present invention relates to an improvement to cyclists' gloves.

Cyclists' gloves should allow the hand to grip efficiently the handlebars, in any position during a competition, and in particular when the hand holds the middle of the handlebars, or the lower part thereof; this requiring a certain suppleness from the material constituting the gloves and limiting the acceptable thickness therefor.

These gloves however are meant to protect the hand from repeated shocks and impacts transmitted to the handlebars by the front wheel, especially through paved roadways or bad patches of roads. They are also required, even where the road surface is good, to prevent the palm of the hand from suffering the effects of continuous pressure due to the weight of the body which mostly rests for 40% on the handlebars and for 60% on the saddle.

The conventionally known cyclists' gloves therefore comprise a reinforcement, generally made of leather, at the level of the palm, which reinforcement gives an extra thickness which can interfere with the closing of the hand when that hand has to grip the handlebars firmly. Moreover, that reinforcement only slightly dampens the vibrations.

It is the object of the present invention to provide inside the glove a lining member, placed between the cyclist's hand and the wall of the glove, the said lining member presenting a part which adopts the outline of the palm of the hand and a collar-shaped part provided with an opening on one side, defining the space between the thumb and the index, when the hand is in a half-closed position, the lining member protecting the hand from shocks and vibrations, and reducing the effects of prolonged pressure due to the weight of the body. The glove is thus pre-shaped in a position which helps the cyclist's hand to grip the handlebars. The lining member is made from an elastic material insulating the hand from vibrations and shocks, and which, not only increases the comfort of the hand and diminishes repercussions of repeated shocks at arm and shoulder level, but also enables the hand to grip the handlebars and reduces the risks of the hand sliding.

The present invention will be more readily understood on reading the following description with reference to the accompanying drawings in which.

Figure 1:
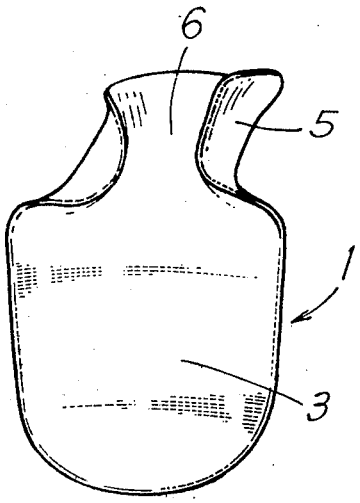
FIG. 1 is a perspective view of the lining member seen from the inside.
Figure 2:
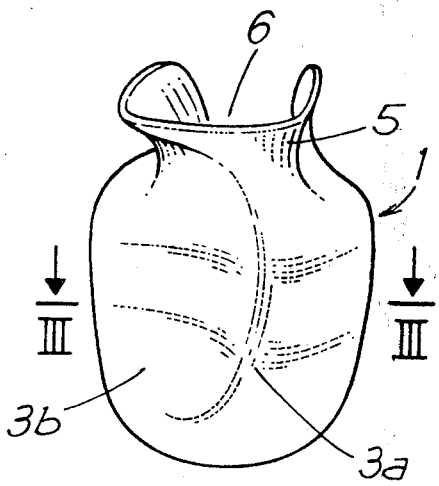
FIG. 2 is a perspective view of the lining member seen from above.
Figure 3:
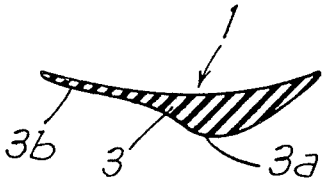
FIG. 3 is a cross-section along line III—III of FIG. 2.

FIGS. 1, 2 and 3 show a lining member 1 which is placed inside a glove 2 (FIGS. 4 and 5) between the hand and the wall of the glove.

Figure 4:
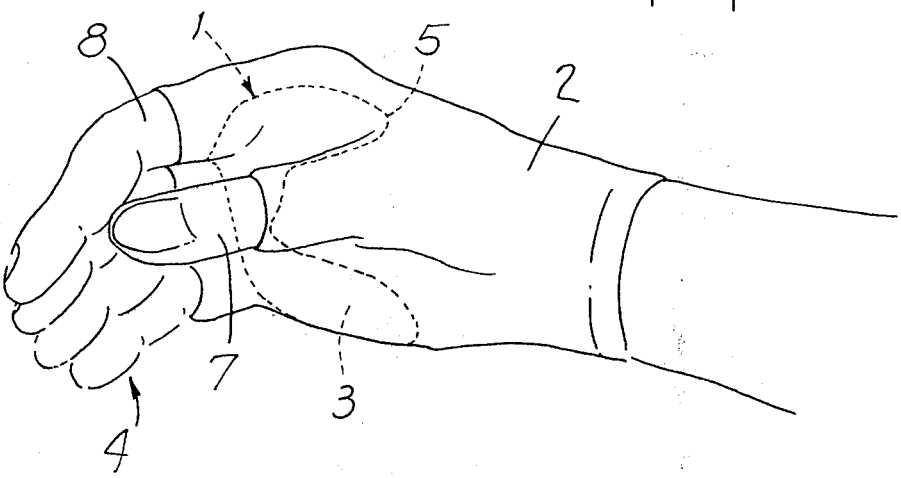
FIG. 4 is a perspective view of a glove equipped with the lining member according to the invention.

Said lining member 1 is constituted by a molded part in elastomer, a material for example, offering protection against vibrations and shocks. Said lining member 1 presents a part 3 of which the face 3*a* (FIG. 3) adopts the outline of the palm of the hand 4 (FIG. 4). Part 3 of the lining member 1 is extended on one side by a collar-shaped part 5 (FIGS. 1, 2) one side of which part is provided with an opening 6 and defines a space between the thumb 7 and the index 8 of the hand.

Figure 5:
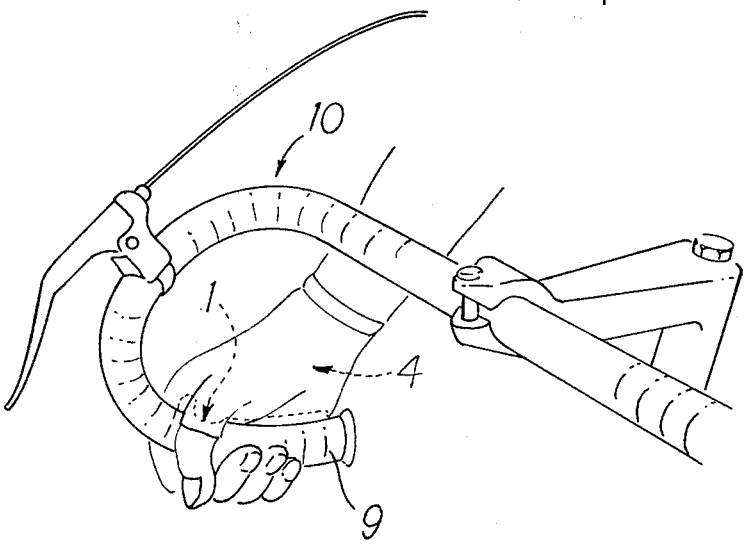
FIG. 5 is a perspective view of the use of an improved glove according to the invention on the handlebars of a bicycle.

This particular arrangement enables the lining member 1, which is located between the palm of the hand and the inside of the glove 2, to insulate the hand from the vibration of the bar 9 of the handlebars 10 (as shown in FIG. 5).

As shown in FIG. 3, part 3 of the lining member is thinned down on its edges 3*b* and is thicker in its middle part.

The present invention is in no way limited to the description given hereinabove and on the contrary covers any modifications that can be brought thereto without departing from the scope thereof.

What is claimed is:

1. Improvement to cyclists' gloves, wherein a lining member is provided inside the glove, which lining member is placed between the cyclist's hand and the wall of the glove, the said lining member having a part which adopts the outline of the palm of the hand and a collar-shaped part provided with an opening on one side, defining the space between the thumb and the index, when the hand is half-closed.

2. Improvement to gloves according to claim 1, wherein the lining member is made of a material which is elastic, and gives a protection against vibrations and shocks.

3. Improvement to gloves as claimed in claim 1, wherein said lining member is obtained by molding an elastomer.

4. Improvement to gloves as claimed in claim 1, wherein the part in contact with the palm of the hand has thin edges and a thicker middle part.

* * * * *